US006788197B1

(12) United States Patent
Thuillard et al.

(10) Patent No.: US 6,788,197 B1
(45) Date of Patent: Sep. 7, 2004

(54) FIRE ALARM

(75) Inventors: Marc Thuillard, Uetikon am See (CH); Erwin Suter, Zurich (CH)

(73) Assignee: Siemens Building Technologies, AG, Mannedorf (CH)

( * ) Notice: Subject to any disclaimer, the term of this patent is extended or adjusted under 35 U.S.C. 154(b) by 462 days.

(21) Appl. No.: 09/711,818

(22) Filed: Nov. 13, 2000

(30) Foreign Application Priority Data

Nov. 19, 1999 (EP) ..... 99122975

(51) Int. Cl.[7] ..... G08B 19/00

(52) U.S. Cl. ..... 340/522; 340/628; 340/630; 340/632; 340/584; 340/587; 340/506

(58) Field of Search ..... 340/506, 517, 340/521, 522, 628, 630, 632, 584, 587, 600

(56) References Cited

U.S. PATENT DOCUMENTS 5,486,811 A * 1/1996 Wehrle et al. ..... 340/522

* cited by examiner

*Primary Examiner*—Daryl Pope
(74) *Attorney, Agent, or Firm*—Baker Botts LLP

(57) ABSTRACT

A fire alarm having an electronic evaluator, an optical module, a temperature sensor, and at least one combustion gas sensor, where the electronic evaluator diagnoses one of a plurality of fire types and selects an application-specific algorithm based on the diagnosed fire type. The electronic evaluator uses the signals from the sensors to diagnose at least one of a plurality of types of fire. The fire alarm may have at least one polarization filter which may be an active polarizer with electrically adjustable polarization plane.

14 Claims, 1 Drawing Sheet

FIRE ALARM

CROSS REFERENCE TO RELATED APPLICATIONS

This application claims benefit to European Patent Application No. EP99 122 975.8, filed Nov. 11, 1999.

BACKGROUND OF INVENTION

1. Field of the Invention

The present invention relates to a fire alarm, and more particularly to a multiple or a multi-sensor fire alarm with an optical module, a combustion gas sensor, a temperature sensor and an electronic evaluator.

2. Description of the Related Art

Modern fire alarms, in particular multi-sensor or multiple fire alarms, can detect fires with a high degree of reliability, and they are very sensitive. In fire alarms of this type, an optical module is used to detect smoke and a temperature sensor is used for detection of the heat occurring at an outlet of a fire. The optical module can measure either the light from the light source that is scattered by smoke particles (scattered-light alarm), or the light from the light source that is attenuated by these smoke particles (a point-extinction or transmitted-light alarm). In both cases, the optical module is designed so that the interfering external light cannot penetrate the measuring chamber while smoke can easily do so. For example, a scattered light alarm with a temperature sensor is disclosed in EP-A-0 654 770. The temperature sensor is used both for increasing the sensitivity and for improving the functioning of the scattered light alarm.

However, the high sensitivity can sometimes lead to false alarms, which is undesirable for a number of reasons. For example, false alarms tend to reduce the attentiveness of the relevant safety personnel. In addition, the fire service and/or the police demand payment for call-outs caused by false alarms which can rise progressively with the number of false alarms. Accordingly, an improved fire alarm with an arrangement for protection against false alarms is required.

SUMMARY OF THE INVENTION

An object of the present fire alarm is to improve the false alarm protection and to reduce the fire alarm's response time.

Another object of the present invention is to provide a more homogeneous alarm response characteristic which would allow the alarm to respond in substantially the same way to different fires, i.e., not extremely rapidly to one type of fire and extremely slowly to another, or even not at all.

In a first embodiment, the fire alarm includes an optical module, a temperature sensor and at least one additional sensor for detecting a combustion gas. The electronic evaluator is coupled to the optical module, temperature sensor and combustion gas sensor and diagnoses various types of fire based on the signals from the sensors.

The optical module of the fire alarm, which generally includes a light source, a measuring chamber and an optical receiver, can be designed so that either the light from the light source that is scattered by smoke particles or the light from the light source that is attenuated by these smoke particles is measured in the measuring chamber. In the first case the detection principle is that of a scattered-light alarm and in the second case that of a transmitted-light alarm. Here the scattered-light alarm can be designed as a forward-scatter or back-scatter device or as a forward-scatter and back-scatter device. The latter has the advantage that the type of smoke that is present can be ascertained with the aid of the scatter at different scatter angles. In this regard, see WO-A-84 01650, which is hereby incorporated by reference.

In one embodiment of the fire alarm, the electronic evaluator is a fuzzy controller.

In another embodiment of the fire alarm, at least one of the included combustion gas sensors is a carbon monoxide sensor.

In yet another embodiment of the fire alarm, the light source of the optical module is designed to emit radiation in the wavelength range of visible light. In this case, the wavelength of the radiation emitted by the light source can be in the range of blue or red light and is preferably 460 nm and 660 nm, respectively.

In a further embodiment of the fire alarm, at least one polarization filter is provided in the path between the light source and the optical receiver. The polarization filter can take the form of an active polarizer with an electrically-adjustable polarization plane.

A type of problem diagnosis in which the fuzzy controller monitors whether certain faults frequently occur below the respective alarm thresholds is also possible. The fuzzy controller can report such faults to the control center or the operating personnel via a suitable communications interface and in this way indicate potential sources of interference whose cause may possibly lie in an incorrect application of the relevant alarm.

Preferably, the active polarizer is formed by a liquid crystal display whose polarization plane can be adjusted by applying a voltage.

DESCRIPTION OF THE DRAWINGS

The invention is explained in further detail below with the aid of an exemplary embodiment and the drawings, of which.

Figure 1:
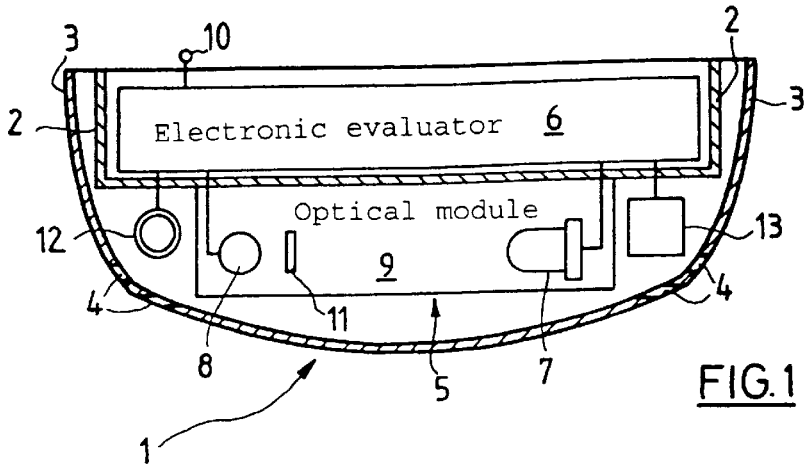
FIG. 1 is a cross sectional view of a fire alarm according to the invention.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DESCRIPTION OF PREFERRED EMBODIMENTS

The fire alarm 1 illustrated in an axial cross-section in FIG. 1 is an optical smoke alarm containing additional sensors for fire parameters. In this representation it is a scattered-light alarm. Since it is assumed that scattered-light optical alarms are known, they are not described in detail here, and reference is made to EP-A-0 616 305 and EP-A-0 821 330. The optical smoke alarm can also be a so-called point-extinction or light absorption alarm, as described in EP-A-1 017 034, for example.

The fire alarm 1 includes an alarm insert 2 that can be attached to a base (not shown) which has been affixed to the ceiling of the room to be monitored. An alarm cover 3 is generally placed over the alarm insert 2. The alarm cover 3 has smoke inlet openings 4 directed towards the room to be monitored. The alarm insert 2 includes a compartment on one side of which, facing the inlet openings 4, is arranged an optical module 5 and on a side of the compartment facing the alarm base is arranged an electronic evaluator 6.

In the case of a scattered-light alarm, the optical module 5 consists substantially of a measuring chamber 9 in which a light source 7 and an optical receiver 8 are placed. The measuring chamber is shielded from external light in a conventional manner (not shown). The optical axes of the light source 7, and the optical receiver 8 are offset with respect to each other such that light beams are prevented from passing directly from the light source 7 to the optical receiver 8. The light source 7 is preferably formed by an infrared or a red or a blue light-emitting diode (IRED or LED, respectively). The light source 7 sends short, high-energy light pulses into the central part of the measuring chamber 9. The optical receiver 8 "sees" this central part of the measuring chamber 9, but because of the angular offset, does not "see" the light source 7.

When smoke enters the openings in the alarm cover 3, the light from the light source 7 is scattered by smoke penetrating the scattered-light space and a portion of this scattered light falls onto the optical receiver 8. The receiver signal produced by this is processed by the electronic evaluator 6. During the processing, the receiver signal is compared in a known manner with an alarm threshold and at least one pre-alarm threshold. If the receiver signal exceeds the alarm threshold, the electronic evaluator 6 generates an alarm signal at an output 10. In this case, intelligent signal processing ensures that the output of the alarm signal occurs at the lowest possible smoke values without giving rise to unacceptable false alarms.

A so-called active polarizer 11, that is a polarizer with a rotatable polarization plane, can be provided in the path between the light source 7 and the optical receiver 8 so that the light scattering can be measured in both polarization planes. This active polarizer is preferably formed by an electronic polarization plate with a liquid crystal, which can rotate its polarization plane by 90° when a voltage is applied. The measurement of the degree of polarization, that is the polarized scattered light in the two polarization planes, can reduce the response time of the alarm 1 to certain test fires and thereby produce a substantially homogeneous response characteristic.

As can also be seen from FIG. 1, in addition to the optical module 5, the fire alarm 1 contains additional sensors for detecting various fire parameters, such as a combustion gas sensor 12 (such as a CO sensor) and a temperature sensor 13. A suitable CO sensor is described in EP-B-0 612 408 (see also EP-A-0 803 850). Negative temperature coefficient (NTC) thermistors have proved successful as temperature sensors (see the PolyRex smoke alarm of the AlgoRex fire alarm system—PolyRex and AlgoRex are registered trademarks of Siemens Building Technologies AG, Cerberus Division, formerly Cerberus AG).

Theoretical considerations and practical fire tests have produced correlations between the fire parameters measured by the optical module 5, the CO sensor 12 and the temperature sensor 13 and various fire types. These are summarized in table 1 below, where TF1 represents a wood fire, TF2 a smouldering wood fire, TF3 a smouldering textile fire, TF4 a foam material fire, TF5 a heptane fire, and TF6 an alcohol fire. Naturally, the amount of smoke or smoke concentration is measured as yet another fire parameter; that is the known function of an optical smoke alarm and thus that of the optical module 5.

TABLE 1

| Fire parameter | TF1 | TF2 | TF3 | TF4 | TF5 | TF6 |
|---|---|---|---|---|---|---|
| CO concentration | high | low | very high | low | low | low |
| CO gradient/T gradient | medium | low | low | medium | high | high |
| T gradient | very high | low | low | high | very high | very high |
| Degree of polarization | very high | low | low | high | very high | low |

The following results can be seen from table 1:

The CO concentration is better than all the other parameters for early detection of TF3 and correlates here with the smoke concentration.

The CO gradient/temperature gradient quotient is very suitable for early detection of TF5 and TF6 and correlates here with the temperature rise.

The temperature rise is very suitable for early detection of TF1, TF5 and TF6 and, with the exception of TF6 (no smoke), correlates with the degree of polarization. This result can be interpreted in that fires which generate a lot of heat produce fairly small aerosol particles. The correlation between a temperature rise and a degree of polarization can be used to confirm the alarm and thus improve the robustness of the fire alarm.

Table 1 also illustrates that all six types of fires can be individually diagnosed with the aid of the CO concentration, CO gradient/T gradient quotient and smoke concentration parameters. This means that the signature of a fire can be unambiguously recognized by means of these parameters. Also, the CO concentration, smoke concentration, and a degree of polarization allow the type of fire to be determined, with the exception of TF6 of course, which cannot be detected with the aid of these parameters. The measurement of the degree of polarization allows the recognition of the type of fire even in cases where the temperature does not rise sufficiently fast. This case can occur in high rooms, for example.

Figure 2:
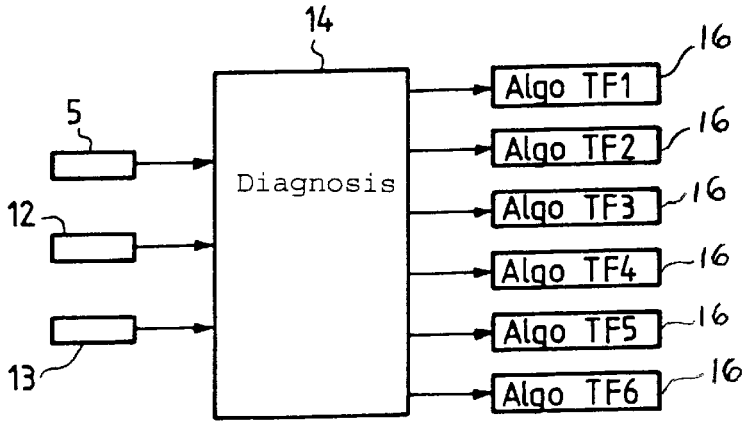
FIG. 2 is a simplified block diagram of the diagnostic and the evaluation processes in the electronic evaluator circuit.

As schematically represented in FIG. 2, the signals of the three sensors are coupled to a diagnostic stage 14 in the electronic evaluator 6, which preferably contains a fuzzy controller, a microprocessor or some other kind of discrete logic processor. The optical module 5 provides a signal from which the concentration and gradient of the smoke concentration and the degree of polarization can be determined. The combustion gas sensor 12 provides a signal from which the concentration and gradient of the combustion gas, such as CO, can be determined. The temperature sensor 13 provides a signal from which the temperature and temperature gradient can be determined. To determine the gradients, the electronic evaluator stores and compares at least two sensor samples over time, in a conventional manner. The signals of the sensors are combined and analyzed in the diagnostic stage 14 and the type of fire is determined from this analysis which effects the classification of fire types in accordance with the correlations set forth above with respect to table 1.

After the fire type is initially determined (i.e., TF1, TF2, TF3, TF4, TF5 or TF6) an appropriate application-specific algorithm 16 or fuzzy logic rules sets for the respective type of fire is selected by the diagnostic stage 14. The application specific algorithm(s) 16 or rules sets can take on many forms depending on the nature of the protected space and the expected fire risks associated with such space. For example, in certain settings there may be a need for an increased protection in the case of certain types of fires such as TF1 (wood fire) and TF4 (foam material fire). Referring to Table 1 above, it can be seen that the temperature gradient and degree of polarization are both suitable for early detection of those fire types. Accordingly, an appropriate application-specific algorithm 16 for these applications would apply a relatively high weighting of the temperature gradient and of the degree of polarization. Conversely, in the case of a smouldering textile fire (TF3), which may be indicative of an incipient fire resulting from smoking in bed, Table 1 illustrates that the carbon monoxide concentration is the most suitable indicator for early detection of such a fire. Accordingly, in this case, an appropriate application-specific algorithm 16 which applied a high weighting of the carbon monoxide concentration could be used. Since the parameters that are being detected are characterized by indistinct values, such as "low," "medium," "high," and "very high," a fuzzy controller is suitable for use in the extraction of clear and distinct results from these indistinct parameters. As already mentioned, the fuzzy controller can also be used for various diagnostic purposes, such as for indicating problems with the sensors, etc.

The optical module 5 of the fire alarm can take the form of a conventional scattered-light alarm with forward scatter or back scatter, or to a scattered-light alarm with forward scatter and back scatter, or a point-extinction or transmitted-light alarm.

It should be pointed out that it can be very advantageous to additionally equip other types of fire alarms with a combustion gas sensor, in particular a CO sensor. Such fire alarms are, for example, the so-called linear smoke alarms or beam alarms such as the type DLO1191 from Siemens Building Technologies AG, Cerberus Division, and the flame alarms, such as the type DF1190 from Siemens Building Technologies AG, Cerberus Division.

Although the present invention has been described in connection with specific exemplary embodiments, it should be understood that various changes, substitutions and alterations can be made to the disclosed embodiments without departing from the spirit and scope of the invention as set forth in the appended claims.

What is claimed is:

1. A fire alarm comprising:

an electronic evaluator;

an optical module electrically coupled to said electronic evaluator;

a temperature sensor operatively coupled to said electronic evaluator; and at least one combustion gas sensor electrically coupled to said electronic evaluator, the electronic evaluator diagnosing one of a plurality of fire types selected from the group consisting of TF1, TF2, TF3, TF4, TF5, and TF6 and selecting an application-specific algorithm based upon said diagnosed fire type for processing of the signals of the optical module and the said sensors.

2. The fire alarm of claim 1, wherein said electronic evaluator is responsive to said optical module, said temperature sensor and said at least one combustion gas sensor to perform said diagnosis of at least one of a plurality of fire types.

3. The fire alarm of claim 2, wherein said electronic evaluator determines a smoke concentration level from said optical module signal, a gradient of the smoke gas from said at least one combustion gas sensor signal, a temperature gradient from said temperature sensor signal, the electronic evaluator determines a parameter generated from the temperature gradient and the gradient of the smoke gas and links the results together to diagnose at least one of a plurality of types of fire.

4. The fire alarm of claim 3, wherein the parameter is generated by the quotient of the temperature gradient and the smoke gas gradient.

5. The fire alarm of claim 1, wherein said at least one combustion gas sensor includes a carbon monoxide sensor.

6. The fire alarm of claim 2, wherein said optical module further comprises a light source, a measuring chamber and an optical receiver.

7. The fire alarm of claim 2, wherein said light source of said optical module emits radiation in the wavelength range of visible light.

8. The fire alarm of claim 7, wherein the wavelength of the radiation is in the range of blue or red light and is 460 nm and 660 nm respectively.

9. The fire alarm of claim 7, further comprising at least one polarization filter interposed between the light source and the optical receiver.

10. The fire alarm of claim 9, wherein said at least one of the polarization filters is an active polarizer operationally coupled to the electronic evaluator and having an electronically adjustable polarization plane.

11. The fire alarm of claim 10, wherein the electronic evaluator weighs data received from said optical receiver with said active polarizer adjusted to at least two different polarization planes.

12. The fire alarm of claim 11, wherein said active polarizer is a liquid crystal device.

13. The fire alarm of claim 12, wherein a degree of polarization of the radiation of said light source that is scattered in said measuring chamber is determined during measurements of smoke concentrations.

14. The fire alarm of claim 2, wherein said electronic evaluator further comprises a fuzzy controller.

* * * * *